US008379894B2

(12) United States Patent
Klinkby

(10) Patent No.: US 8,379,894 B2
(45) Date of Patent: Feb. 19, 2013

(54) HEARING AID WITH ADAPTIVE FEEDBACK SUPPRESSION

(75) Inventor: Kristian Tjalfe Klinkby, Varlose (DK)

(73) Assignee: Widex A/S, Lynge (DK)

( * ) Notice: Subject to any disclaimer, the term of this patent is extended or adjusted under 35 U.S.C. 154(b) by 983 days.

(21) Appl. No.: 12/185,895

(22) Filed: Aug. 5, 2008

(65) Prior Publication Data

US 2009/0028366 A1 Jan. 29, 2009

Related U.S. Application Data

(63) Continuation-in-part of application No. PCT/EP2006/060576, filed on Mar. 9, 2006.

(51) Int. Cl.
*H04R 25/00* (2006.01)

(52) U.S. Cl. ..... 381/318; 381/312; 381/317

(58) Field of Classification Search ..... 381/312–331
See application file for complete search history.

(56) References Cited

U.S. PATENT DOCUMENTS

2003/0053647 A1* 3/2003 Kates ..... 381/318
2004/0125966 A1 7/2004 Weidner

FOREIGN PATENT DOCUMENTS

WO 0019605 4/2000
WO 0225996 A1 3/2002
WO 2005/096670 A1 10/2005

OTHER PUBLICATIONS

Office Action May 24, 2011 for JP2008557601 with English Translation.
Chi et al, "Band-limited feed back cancellation with a modified filtered-x LMS algorithm for hearing aids", Speech Communication, Elsevier Science Publishers, Amsterdam, Netherlands, vol. 39, No. 1-3, Jan. 2003, pp. 147-161, XP002295470.
Marcia Siqueira et al, Steady-State Analysis of Continuous Adaptation in Acoustic Feedback Reduction Systems for Hearing-Aids, IEEE Transactions on Speech and Audio Processing, vol. 8, No. 4, Jul. 2000, pp. 443-453.
Philip A. Regalia, "Adaptive IIR Filtering in Signal Processing and Control"—Copyright 1995.

* cited by examiner

*Primary Examiner* — Yuwen Pan
*Assistant Examiner* — Matthew Eason
(74) *Attorney, Agent, or Firm* — Sughrue Mion, PLLC

(57) ABSTRACT

A hearing aid comprises an input transducer (2) for deriving an electrical input signal from an acoustic input, a signal processor (3) for generating an electric output signal, an output transducer (4) for transforming the electrical output signal into an acoustic output, an adaptive estimation filter (5) for generating a feedback estimation signal, at least one first adaptive narrow-band filter (8) for narrow-band-filtering an input signal of the signal processor (3) at least one second adaptive narrow-band filter (9) for narrow-band-filtering a reference signal corresponding to an input signal of the adaptive estimation filter (5), and an adaptation mechanism (6) for updating the filter coefficients of the adaptive estimation filter (5) based on the output signals of the first and second narrow-band filters. The invention further provides a method for reducing acoustic feedback and an electronic circuit.

18 Claims, 9 Drawing Sheets

HEARING AID WITH ADAPTIVE FEEDBACK SUPPRESSION

RELATED APPLICATIONS

The present application is a continuation-in-part of application no. PCT/EP2006/060576 filed on Mar. 9, 2006 and published as WO-A1-2007101477, the contents of which are incorporated herein by reference.

BACKGROUND OF THE INVENTION

1. Field of the Invention

The invention relates to the field of hearing aids. The invention, more specifically, relates to a hearing aid having an adaptive filter for suppressing acoustic feedback. The invention also relates to a method of adaptively reducing acoustic feedback of a hearing aid and to an electronic circuit for a hearing aid.

2. Description of the Related Art

Acoustic feedback occurs in all hearing instruments when sounds leak from the vent or seal between the earmould and the ear canal. In most cases, acoustic feedback is not audible. But when the in-situ gain of the hearing aid is sufficiently high, or when a larger than optimal size vent is used, the gain of the hearing aid can exceed the attenuation offered by the ear mould/shell. The output of the hearing aid then becomes unstable and the once-inaudible acoustic feedback becomes audible, e.g. in the form of a whistling noise. For many users and people around, such audible acoustic feedback is an annoyance and even an embarrassment. In addition, hearing instruments that are at the verge of feedback, i.e. in a state of sub-oscillatory feedback, may suffer an adverse influence to the frequency characteristic of the hearing instrument, and potentially intermittent whistling.

Generally a hearing aid comprises an input transducer or microphone transforming an acoustic input signal, a signal processor amplifying the input signal and generating an electrical output signal and an output transducer or receiver for transforming the electrical output signal into an acoustic output. The acoustic propagation path from the output transducer to the input transducer is referred to as the acoustic feedback path of the hearing aid, the attenuation factor of the feedback path being denoted by $\beta$. If, in a certain frequency range, the product of gain G (including transformation efficiency of microphone and receiver) of the processor and the attenuation $\beta$ is close to 1, audible acoustic feedback occurs.

WO-A1-02/25996 describes a hearing aid including an adaptive filter intended to suppress undesired feedback. The adaptive filter estimates the transfer function from output to input of the hearing aid including the acoustic propagation path from the output transducer to the input transducer. The input of the adaptive filter is connected to the output of the hearing aid and the output signal of the adaptive feedback estimation filter is subtracted from the input transducer signal to compensate for the acoustic feedback. In this hearing aid the output signal from the signal processor is fed to an adaptive feedback estimation filter, which is controlled by a filter control unit. The adaptive feedback estimation filter constantly monitors the feedback path providing an estimate of the feedback signal and producing an output signal which is subtracted from the processor input signal in order to reduce, or in the ideal case to eliminate, acoustic feedback in the signal path of the hearing aid.

An overview of adaptive filtering is given in the textbook of Philipp A. Regalia: "Adaptive IIR Filtering in Signal Processing and Control", published in 1995.

One problem associated with adaptive feedback cancelling is a bias introduced by the feedback prediction model itself through narrow band signals included e.g. in speech or music. The correlation analysis of the adaptive feedback estimation algorithm is based on the assumption that a feedback signal (oscillation) is a highly correlated version of the original signal. When signal components of the external hearing aid input, e.g. contained in speech or music, are narrow band signals, a bias is introduced in the feedback prediction model and the external narrow band signal components are removed from the hearing aid signal path by the feedback suppression algorithm.

Siqueira and Alwan propose, in "Steady-State Analysis of Continuous Adaptation in Acoustic Feedback Reduction Systems for Hearing Aids", IEEE transactions on speech and audio processing, Vol. XIII, no. 4, pages 443-453, July 2000, the use of a delay in the forward or cancellation path of the hearing aid in order to reduce the bias introduced by narrow band input signals. This delay, however, does still not make a sinosoid signal unpredictable by the feedback cancellation algorithm.

US 2003/0053647 A1 to Kates shows a hearing aid comprising a cascade of adaptive notch filters for processing to the error signal before a signal is supplied to the feedback path estimation algorithm. The series of notch filters removes the narrow band signal components from the feedback estimation algorithm so that the mean square error (MSE) calculation in the adaptive feedback estimation filter does not take into account the external narrow band signal components and interpolates the feedback path model over the absent frequencies.

To ensure a correct mean square error minimization process with respect to the narrow band filtered error signal the input signal of the adaptive feedback estimation filter must be filtered with copies of the adaptive notch filters before it is fed to the adaptation algorithm.

Furthermore, the narrow band filters are optimized to cancel the narrow band signal components by minimizing a cost function of the narrow band filter output.

In order to remove a plurality of narrow band signal components a plurality of notch filters are required. With an increasing number of notch filters for different frequencies, however, the computational costs increase and mutual influence of the different notch filters may occur.

SUMMARY OF THE INVENTION

It is therefore an object of the present invention to provide a hearing aid with adaptive feedback cancellation, and a method of adaptively reducing acoustic feedback of a hearing aid, having improved feedback-cancellation properties at optimized calculation costs.

The invention, in a first aspect provides a hearing aid comprising: an input transducer for deriving an electrical input signal from an acoustic input; a signal processor for generating an electric output signal; an output transducer for transforming the electrical output signal into an acoustic output; an adaptive estimation filter for generating a feedback estimation signal; at least one first adaptive narrow-band filter for narrow-band-filtering an input signal of the signal processor; at least one second adaptive narrow-band filter for narrow-band-filtering a reference signal corresponding to an input signal of the adaptive estimation filter; an adaptation mechanism for updating the filter coefficients of the adaptive estimation filter based on the output signals of the first and second narrow-band filters; wherein the filters of the first and second adaptive narrow-band filters are each configured as a cascade of filter stages, and each configured to minimize a single shared cost function, and wherein the cost function derived from an output signal of the last filter stage is fed back to all filter stages of the cascade of filter stages.

To ensure a correct cost function (e.g. mean square error) minimization process of the narrow band-filtered error signal (input signal of hearing aid processor), the input signal of the adaptive estimation filter must also be filtered with copies of the adaptive narrow-band filter(s) before it is fed to the filter control unit.

Preferably the at least one first adaptive narrow-band filter and the at least one second adaptive narrow-band filter minimize a cost function of its output signal, e.g. the signal energy or a signal norm. The minimization may be performed by a least mean square type or similar algorithm.

As an alternative to minimizing the narrow-band filter output it is possible to use a formula for maximizing the output of a resonator of a given frequency corresponding to the center frequency of the adaptive narrow-band filter and having a constrained pole radius.

In order to optimize the frequency adaptation of the narrow-band filter a combined gradient may be employed, wherein a narrow band gradient is calculated if the center frequency adaptation rate of the filter is below a predetermined threshold value, and a broader band gradient is calculated if the center frequency adaptation rate of the narrow-band filter is above this threshold value.

The adaptive estimation filter preferably employs a least mean square (LMS) algorithm for feedback reduction.

The adaptation mechanism advantageously carries out a cross correlation processing of the narrow-band filtered error signal with the narrow-band filtered reference signal.

As adaptive narrow-band filters one or preferably a plurality of adaptive notch filters with predetermined frequency width r may be employed, wherein the plurality of notch filters have different adaptive center frequencies c(n).

The Invention, in a second aspect, provides a method of adaptively reducing an acoustic feedback of a hearing aid having an input transducer for deriving an electrical input signal from an acoustic input, a signal processor for generating an electrical output signal and an output transducer for transforming the electrical output signal into an acoustic output, the method comprising the steps of: generating a feedback estimation signal; deriving an error signal by subtracting the feedback estimation signal from the electrical input signal; narrow-band-filtering the error signal and a reference signal corresponding to a feedback estimation input signal in a plurality of filter stages having different adaptive center frequencies; adapting feedback estimation filter coefficients based on the narrow-band-filtered error and reference signals; wherein the narrow-band filtering using a plurality of different adaptive center frequencies is performed using a cascade of filter stages, and minimizing a single shared cost function for the different adaptive center frequencies, wherein the cost function derived from an output signal of the last filter stage is fed back to all filter stages of the cascade of filter stages.

The Invention, in a third aspect, provides an electronic circuit for a hearing aid comprising: a signal processor for processing an electrical input signal derived from an acoustic input and generating an electrical output signal; an adaptive estimation filter for generating a feedback estimation signal; at least one first adaptive narrow-band filter for narrow-band-filtering an input signal of the signal processor; at least one second adaptive narrow-band filter for narrow-band-filtering a reference signal corresponding to an input signal of the adaptive estimation filter; an adaptation mechanism for updating the filter coefficients of the adaptive estimation filter based on the output signals of the first and second narrow-band filters; wherein the first and second adaptive narrow-band filters are each configured as a cascade of filter stages, and each configured to minimize a single shared cost function, wherein the cost function derived from an output signal of the last filter stage is fed back to all filter stages of the cascade of filter stages.

For the plurality of narrow-band filters forming the first filter set for filtering the error signal and for the plurality of narrow-band filters forming the second filter set for filtering the reference signal one respective shared cost function is minimized thus improving the overall narrow band signal suppression. The shared cost function makes each notch filter aware of the effectiveness of all the notch filters.

In order to reduce the calculation costs of the gradient calculation a tree structure of the first set of notch filters may be used. In this case the number of notch filters is preferably $2^N$ (N=2, 3, 4, 5 . . . ).

Another possibility to reduce the computation costs of the gradient calculation is to perform these independently for every filter while at the same time using a shared error function for all filters of the set of notch filters.

The invention, in a further aspect, provides a computer program for performing a method of adaptively reducing acoustic feedback.

Further specific variations of the invention are defined by the further dependent claims.

BRIEF DESCRIPTION OF THE DRAWINGS

The present invention and further features and advantages thereof will become more readily apparent from the following detailed description of particular embodiments of the invention given with reference to the drawings, in which.

DESCRIPTION OF EMBODIMENTS OF THE INVENTION

Figure 1:
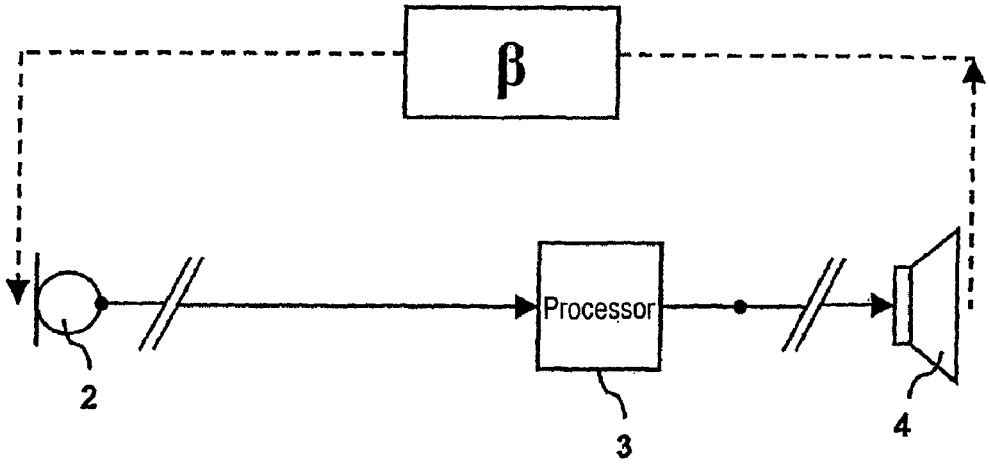
FIG. 1 is a schematic block diagram illustrating the acoustic feedback path of a hearing aid.
Figure 2:
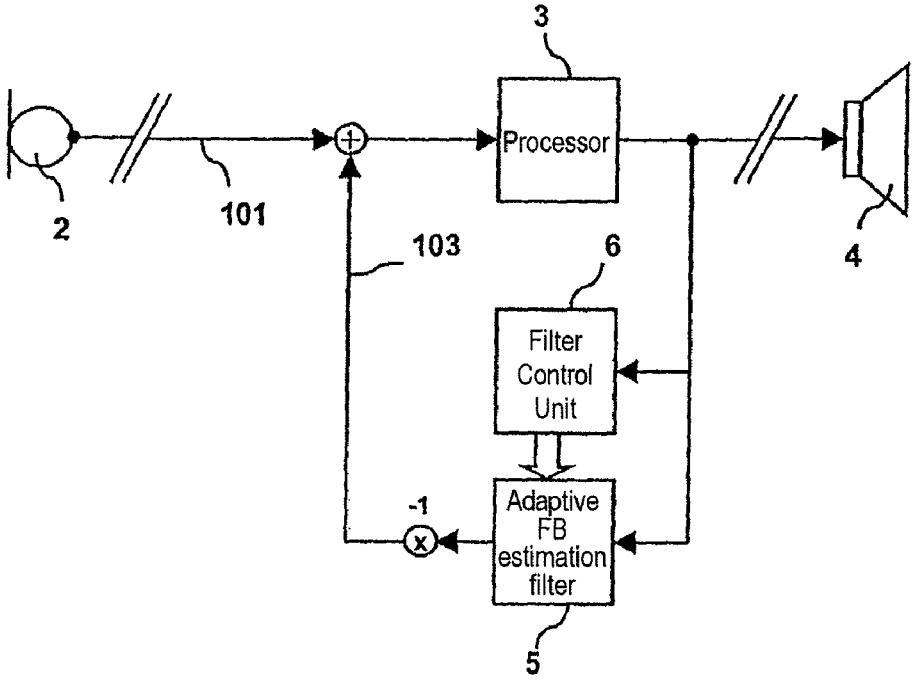
Prior Art Fig. 2
FIG. 2 is a block diagram showing a prior art hearing aid.

FIG. 1 shows a simple block diagram of a hearing aid comprising an input transducer or microphone transforming an acoustic input signal, a signal processor amplifying the input signal and generating an electrical output signal and an output transducer or receiver for transforming the electrical output signal into an acoustic output. The acoustic feedback path of the hearing aid is depicted by broken arrows, whereby the attenuation factor is denoted by β. If, in a certain frequency range, the product of gain G (including transformation efficiency of microphone and receiver) of the processor and the attenuation β is close to 1, audible acoustic feedback occurs.

WO-A1-02/25996 describes a hearing aid including an adaptive filter intend to suppress undesired feedback. The adaptive filter estimates the transfer function from output to input of the hearing aid including the acoustic propagation path from the output transducer to the input transducer. The input of the adaptive filter is connected to the output of the hearing aid and the output signal of the adaptive feedback estimation filter is subtracted from the input transducer signal to compensate for the acoustic feedback. In this hearing aid the output signal from the signal processor is fed to an adaptive feedback estimation filter, which is controlled by a filter control unit.

Figure 3:
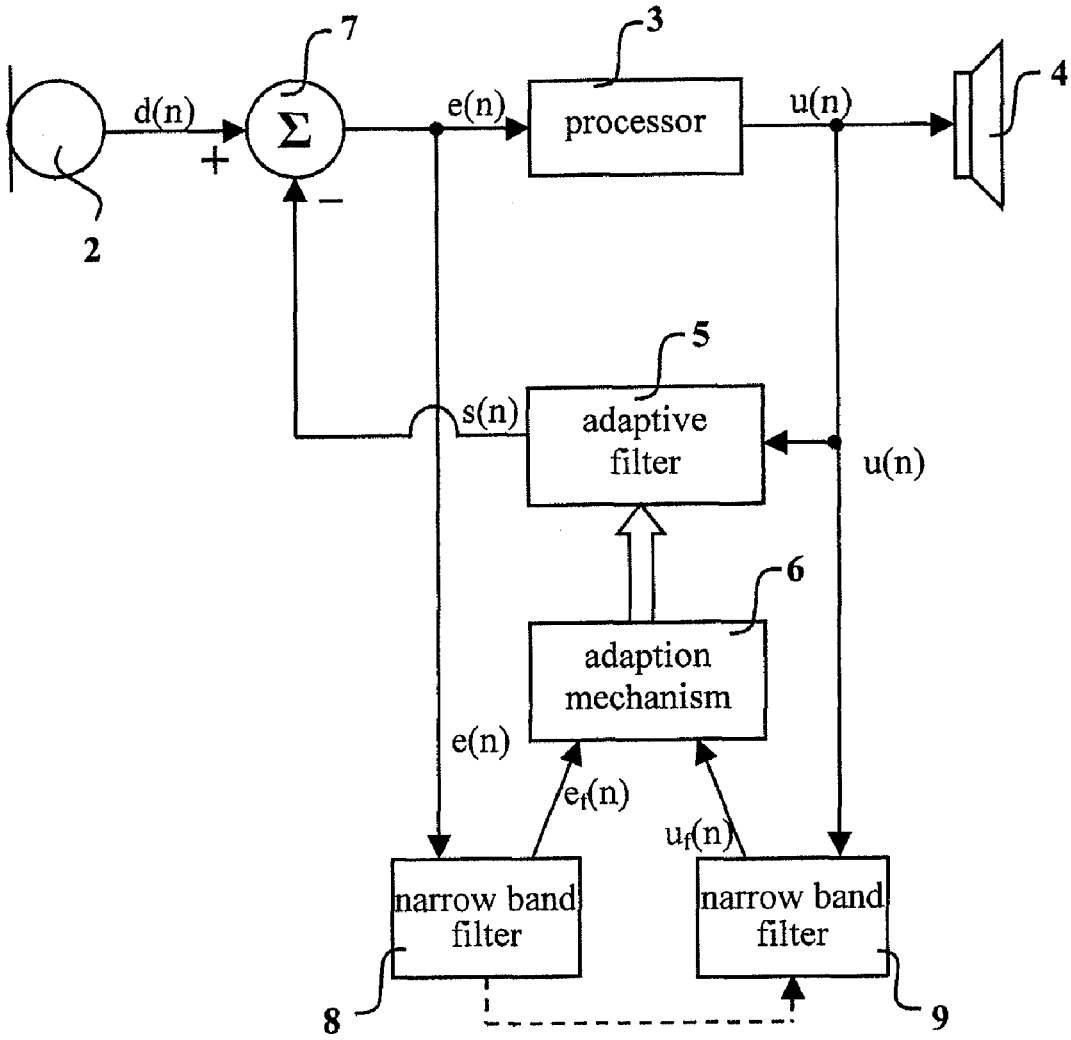
FIG. 3 is a block diagram showing a hearing aid to which the present application may be applied.

FIG. 3 is a schematic block diagram of a hearing aid having an adaptive filter for feedback suppression to which the present application may be applied.

The signal path of the hearing aid comprises an input transducer or microphone 2 transforming an acoustic input into an electrical input signal, a signal processor or amplifier 3 generating an amplified electrical output signal and an output transducer (loudspeaker, receiver) 4 for transforming the electrical output signal into an acoustic output. The amplification characteristic of the signal processor 3 may be non-linear providing more gain at low signal levels and may include compression characteristics, as is well known in the art.

The electrical output signal or reference signal u(n) is fed to an adaptive filter 5 monitoring the feedback path and executing an adaptation algorithm 6 adjusting the digital filter 5 such that it simulates the acoustic feedback path, enabling it to provide an estimate of the acoustic feedback. The adaptive estimation filter 5 generates an output signal s(n) which is subtracted from input signal d(n) at summing node 7. In the ideal case the feedback of feedback path β in FIG. 1 is therefore absent in the processor input signal or error signal e(n).

The adaptive estimation filter 5 is designed to minimize a cost function, e.g. the power of the error signal e(n). The adaptive filter may be embodied (but is not restricted to a K-tab finite impulse response (FIR) filter having adaptive coefficients $b_1(n)$ through $b_k(n)$. A power-normalized adaptive filter update for a sample n of the digital electrical signal can then be expressed as follows:

$$b_k(n+1) = b_k(n) + 2\frac{v}{\sigma_d^2(n)}e(n)u(n-k) \tag{1}$$

wherein v controls the rate of adaptation and $\sigma^2_d(n)$ is the average power in the feedback path signal u(n). If the input of the adaptive filter is a pure (sine) tone the adaptive feedback cancellation system minimizes the error signal e(n) by adjusting the filter coefficients $b_1(n)$ through $b_k(n)$ so that the output signal s(n) has the same amplitude and phase as the input and will consequently cancel it at summing node 7.

To avoid this undesirable effect of cancelling narrow band components of non-feedback input signals it is known to use narrow-band filters such as a series of notch filters 8, 9. Narrow-band filter 8 is used for narrow-band filtering the error signal e(n) while narrow-band filter 9 is used for narrow-band filtering the processor output signal or reference signal u(n). The adaptive narrow-band filters 8, 9 operate with mutually identical filter coefficients, i.e. the filter coefficients of narrow-band filter 8 are copied to narrow-band filter 9. In a variant of this embodiment, they are copied from 9 to 8. Both filters may consist of a cascade of filters connected in series to each other and having different adaptive center frequencies. The output signal of the first narrow-band filter, i.e. narrow-band filtered error signal $e_f(n)$ and the output signal of the second narrow-band filter, i.e. narrow-band filtered reference signal $u_f(n)$ are fed to adaptation mechanism 6 controlling the filter coefficients of adaptive error estimation filter 5. Adaptation mechanism 6 performs a cross correlation of its input signals $e_f(n)$ and $u_f(n)$.

Figure 4:
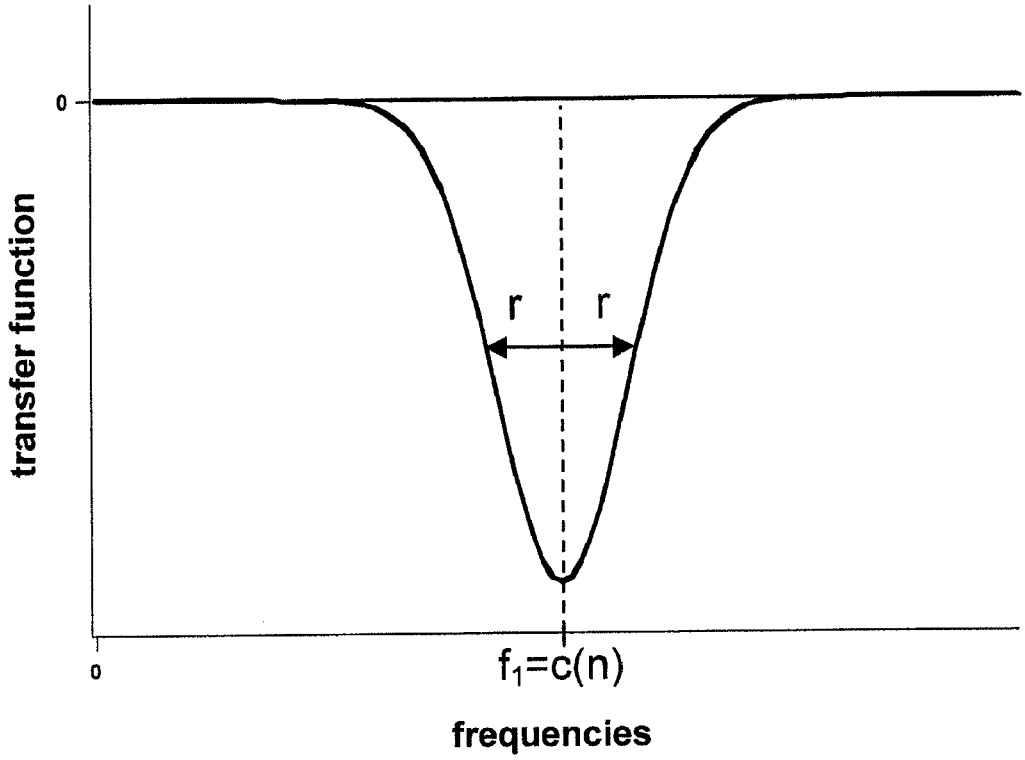
FIG. 4 is a diagram illustrating the transfer function of a notch filter.

Preferably the adaptive narrow-band filters 8, 9 are implemented by digital notch filters, having the transfer function $$H(z) = \frac{1 - 2\cos(\omega_0/f_s)z^{-1} + z^{-2}}{1 - 2r\cos(\omega_0/f_s)z^{-1} + r^2z^{-2}} \tag{2}$$

in frequency domain z, wherein r is the pole radius of the notch filter, $\omega_0$ the center frequency in radians, and $f_s$ the sampling frequency. r preferably assumes values between 0.5 and 1 and in particular between 0.95 and 1. A schematic illustration of the transfer function of a notch filter is illustrated in FIG. 4.

In recursive notation depending on sampling index n the notch filter 8 for error signal e(n) can be expressed as follows $$\left.\begin{aligned} x(n) &= e(n) - 2\cdot r\cdot c(n)\cdot x(n-1) - r^2\cdot x(n-2) \\ e_f(n) &= x(n) + 2\cdot c(n)\cdot x(n-1) + x(n-2) \end{aligned}\right\}\text{Notch filter} \tag{3}$$

wherein x(n) is an output signal from filtering with just the pole pair and $e_f(n)$ is the result of additional filtering with the zero pair, wherein c(n) is the adaptive notch frequency of the notch filter. The frequency adaptation is given by:

$$c(n+1) = c(n) - \frac{\mu}{p(n)}\cdot e_f(n)\cdot\nabla c(n)^2 \tag{4}$$

wherein μ determines the update speed of the center frequency of the notch and p(n) is a power normalisation:

$$p(n)=\alpha\cdot p(n-1)+\nabla c(n)^2 \tag{5}$$

wherein α is a forgetting factor of the power normalisation and ∇c(n) is the gradient of the notch filter. This gradient can be calculated in different ways as is explained in the following:

(1) True Gradient Algorithm

The true gradient of a direct form II notch filter is calculated as follows:

$$g(n)=(1-r)\cdot x(n-1)-r\cdot c(n)\cdot g(n-1)-r^2\cdot g(n-2)$$

$$\nabla' c(n)=g(n)-r\cdot g(n-2) \tag{6}$$

wherein g(n) is the status of the gradient calculation. The true gradient provides a high signal sensitivity in the vicinity of the center frequency c(n) but bears a comparatively high computational cost.

(2) Pseudo Gradient Algorithm

Another way to calculate an update method of c(n) is the simplified pseudo gradient method. This algorithm is derived from the assumption that the first line of (3) can be ignored or regarded as pre-filtering of the second line in (3) and hence the so-called pseudo gradient is calculated as follows:

$$\nabla^p c(n)=x(n-1) \tag{7}$$

Figure 11:
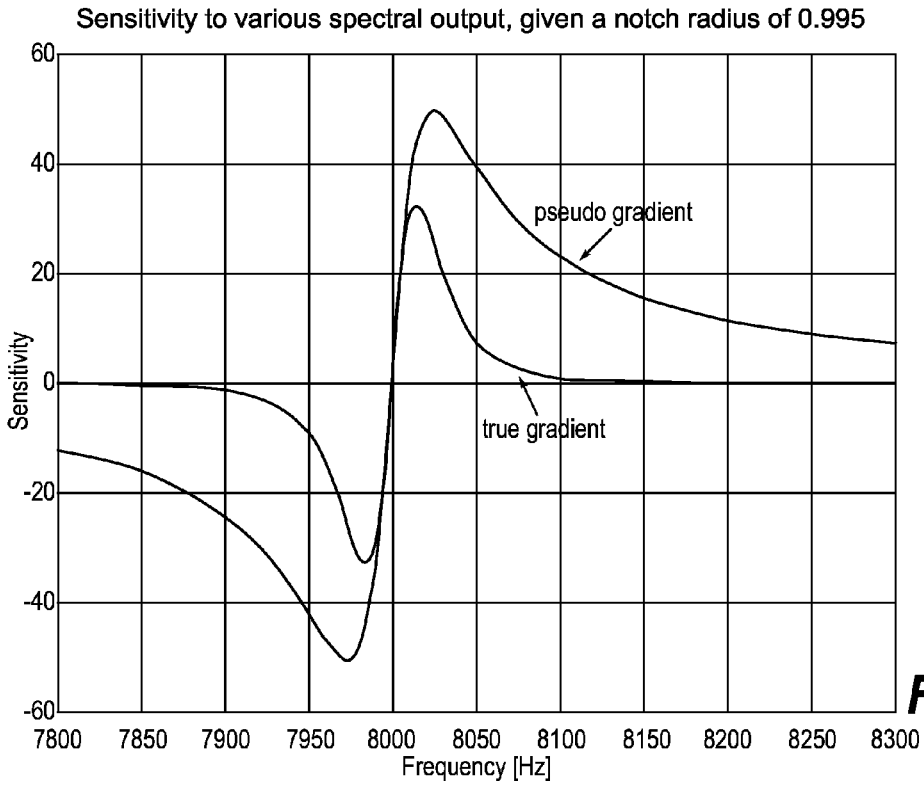
FIG. 11 is a diagram illustrating the sensitivity of two types of gradient filters.

Besides the lower computational cost compared with the true gradient method, the simplified pseudo gradient is characterized by its larger sensitivity to spectral energies in the periphery of the notch center frequency and hence its relative less sensitivity to the spectral envelope in the vicinity of the notch frequency. This is illustrated by the graph of FIG. 11 showing the sensitivity of the true gradient and the pseudo gradient dependent on a sinusoid input frequency at a given selected notch center frequency of 8000 Hz, notch width of 500 Hz and notch radius r=0.995. The pseudo gradient is advantageous having a narrow band signal component in the periphery of the current notch center frequency, but if the notch has converged to the frequency of the narrow band signal component, it is more advantageous to use the true gradient as it is more accurate in its frequency estimate since it is less disturbed by signals in the periphery.

(3) Combined Gradient

According to an aspect of the present invention a combined gradient is suggested which monitors some sort of mean pseudo gradient. If this is above a specified threshold the mean pseudo gradient is utilized instead of the true gradient algorithm, which in turn is utilized below the threshold. A preferred embodiment is given below, which monitors the pseudo gradient with an exponential decaying time window:

$$m(n) = \lambda \cdot m(n-1) - \frac{\mu}{p_{ps}(n)} \cdot e_f(n) \cdot \nabla^p c(n) \tag{8}$$

$$|m(n)| > \beta?$$

wherein λ determines the forgetting factor of the exponential decaying time window of the monitored mean pseudo gradient drive m(n) and β specifies the threshold value above which the pseudo gradient is utilized. That is if |m(n)|>β then the pseudo gradient of formula (7) is used in the frequency update calculation of formula (4) and otherwise the true gradient given in formula (6) is utilized. Also, the respective gradients have to be inserted in the weighting factor calculation defined by (5). This combined filter or "pseudo to true gradient filter" (6) combines the advantages of both gradient algorithms discussed above, i.e. the better sensitivity of the pseudo gradient with respect to narrow band signal components in the periphery of the notch frequency and the higher accuracy of the true gradient close to the current center frequency c(n).

According to the present invention the calculation of the narrow-band filtered reference signal $u_f(n)$ is needed to perform the calculation of the gradient $\nabla_{bk}(n)$ of the narrow-band filtered error signal $e_f(n)$ with respect to the filter coefficients $b_1(n)$ through $b_k(n)$ of the adaptive feedback estimation filter 5 as is defined by the following formula:

$$\nabla_{bk}(n) = Z^{-1}\left(U(z)\left(\prod_{j=1}^{M} \frac{1+\omega \cdot z^{-1}+z^{-2}}{1+rc_j \cdot z^{-1}+r^2 \cdot z^{-2}}\right)z^{-k}\right) \tag{9}$$

Figure 5:
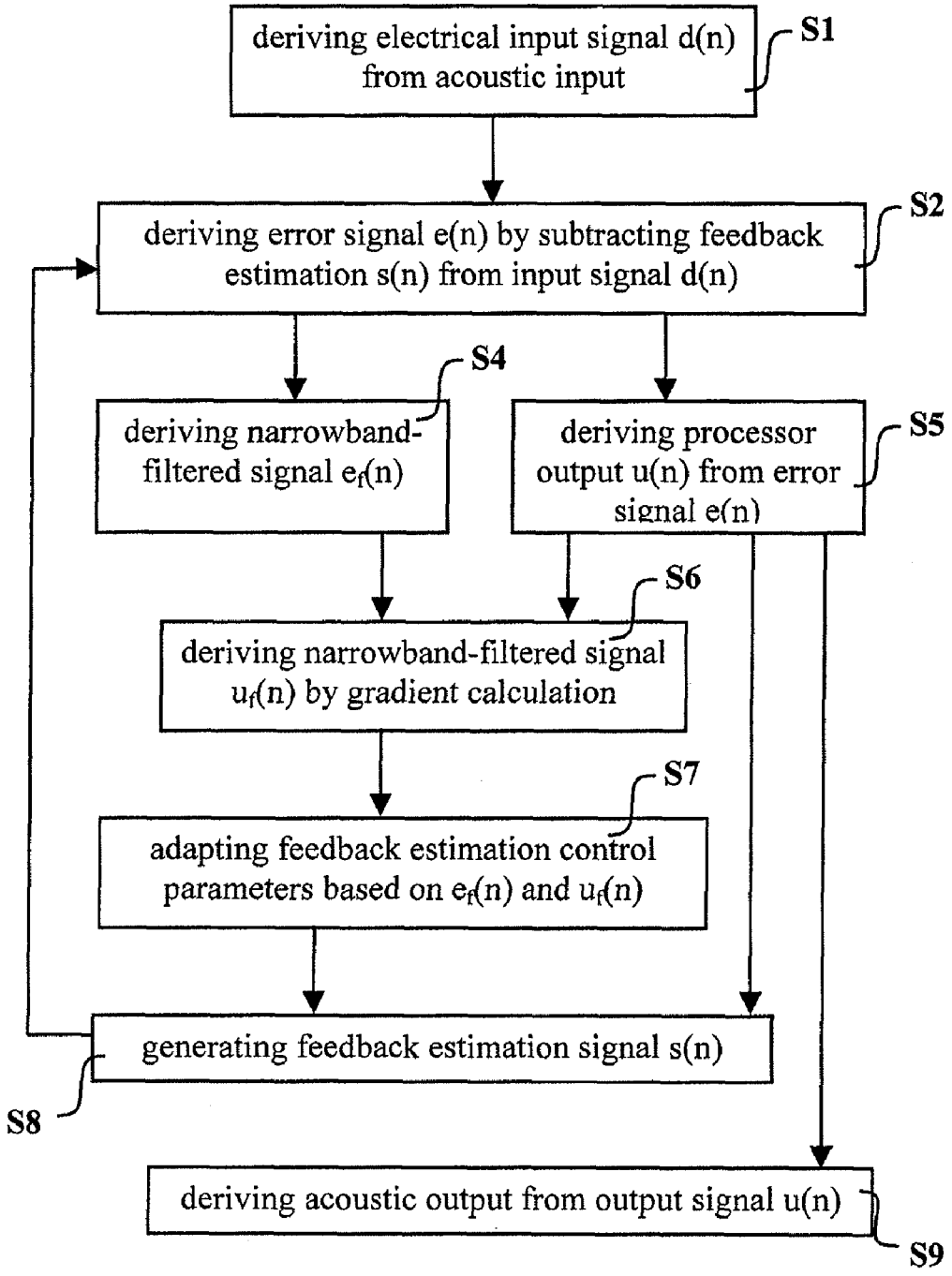
FIG. 5 is a flow chart illustrating a method of adaptively reducing the acoustic feedback of a hearing aid according to an embodiment of the present invention.

FIG. 5 illustrates a particular embodiment of a method of adaptively reducing the acoustic feedback of a hearing aid according to the present invention.

In method step S1 an electrical input signal d(n) is derived from the acoustic input of microphone 2. In subsequent method step S2 error signal e(n) is derived at summing node 7 by subtracting feedback estimation signal s(n) from input signal d(n). Error signal e(n) is then fed to signal processor 3 producing output signal u(n) in step S5 which is then transformed into the acoustic output by receiver 4 in method step S9.

With the at least one narrow-band filter 8 a narrow-band filtered signal $e_f(n)$ of the error signal is calculated in method step S4. In subsequent step S6 the narrow-band filtered signal $u_f(n)$ of reference signal u(n) is calculated in the at least one narrow-band filter 9 utilizing the narrow-band filter coefficients found in S4.

In step S7 the feedback estimation filter parameters of adaptive estimation filter 5 are adapted based on the cross correlation of narrow-band filtered signals $e_f(n)$ and $u_f(n)$. Adaptive estimation filter 5 then derives feedback estimation signal s(n) in method step S8 which is fed to the negative input of summing node 7.

The adaptation algorithm performed by adaptive estimation filter 5 in method step S8 is preferably performed such that a cost function of the narrow-band filtered error signal $e_f(n)$ is minimized. This cost function may be the signal energy or a norm of the signal. Most commonly the mean square error (MSE) function is minimized resulting in the widely known least mean square (LMS) algorithm.

Narrow-band filters 8, 9 are preferably optimized to cancel narrow band signal components. This may be obtained by minimizing a cost function of the narrow-band filter output. This cost function may also be the MSE leading to an LMS type algorithm.

Instead of minimizing the output of the narrow-band filter it is alternatively possible to use a formula for maximizing the output of a resonator with constrained pole radius. After maximizing the resonator output a notch may be constructed from the very same filter. A notch adaptation algorithm maximizing such resonator energy J can be derived as follows:

$$J = E[x^2(n)] = MSE \tag{10}$$

$$\frac{\partial J}{\partial c} = E\left[2 \cdot x(n) \cdot \frac{\partial x(n)}{\partial c}\right]$$

(Adjust $c$ in the gradients direction as to increase $J$)

The corresponding gradient is then expressed as follows:

$$\begin{aligned} \nabla^m c(n) &= \frac{\partial x(n)}{\partial c} \\ &= Z^{-1}\left(\frac{\partial X(z)}{\partial c}\right) \\ &= Z^{-1}\left(\frac{\partial\left(E(z) \cdot \frac{1}{1+c \cdot r \cdot z^{-1}+r^2 \cdot z^{-2}}\right)}{\partial c}\right) \end{aligned} \tag{11}$$

-continued $$= Z^{-1}\left(E(z)\cdot\frac{-r\cdot z^{-1}}{(1+c\cdot r\cdot z^{-1}+r^2\cdot z^{-2})^2}\right)$$

wherein E(z) is the Z-domain (frequency) representation of the notch input signal and $Z^{-1}$ the inverse-z-transformation back into time-domain signal. In time domain dependent on index n the gradient is represented as follows:

$$g(n)=x(n)-r\cdot c(n)\cdot g(n-1)-r^2\cdot g(n-2)$$

$$\nabla^m c(n)=-rg(n-1) \tag{12}$$

wherein the notch filter is determined by equation (3) and the weighting function p(n) and the frequency update c(n+1) are given as follows:

$$p(n)=\alpha\cdot p(n-1)+\nabla^m c(n)^2 \tag{13}$$

$$c(n+1)=c(n)+\frac{\mu}{p(n)}\cdot x(n)\cdot\nabla^m c(n)$$

Similar to the simplified pseudo gradient discussed above a simplified pseudo gradient algorithm can be constructed if one constrains the notch's zeroes to prefilter the input of the adaptive notch. The gradient algorithm is in the following referred to as "pseudo maxres gradient":

$$J=E[e_f(n)^2] \tag{14}$$

$$\frac{\partial J}{\partial c}=E\left[2\cdot e_f(n)\cdot\frac{\partial e_f(n)}{\partial c}\bigg|_{Pseudo\ \max\ res}\right]$$

$$\begin{aligned}
\nabla^{pm}c(n) &= \frac{\partial e_f(n)}{\partial c}\bigg|_{Pseudo\ \max\ res}\\
&= Z^{-1}\left(\frac{\partial E_f(z)}{\partial c}\bigg|_{Pseudo\ \max\ res}\right)\\
&= Z^{-1}\left(\underbrace{\frac{E(z)}{\text{Input}}}\cdot\underbrace{(1+c\cdot z^{-1}+1\cdot z^{-2})}_{\text{Zeroprefilter}}\cdot\underbrace{\frac{\dfrac{1}{1+r\cdot c\cdot z^{-1}+r^2\cdot z^{-2}}}{\dfrac{\partial}{\partial c}}}_{\text{Maxresgradient}}\right)\\
&= Z^{-1}\left(E(z)\cdot(1+c\cdot z^{-1}+1\cdot z^{-2})\cdot\frac{-r\cdot z^{-1}}{(1+r\cdot c\cdot z^{-1}+r^2\cdot z^{-2})^2}\right)\\
&= Z^{-1}\left(E(z)\cdot\frac{1+c\cdot z^{-1}+1\cdot z^{-2}}{1+r\cdot c\cdot z^{-1}+r^2\cdot z^{-2}}\cdot\frac{-r\cdot z^{-1}}{1+r\cdot c\cdot z^{-1}+r^2\cdot z^{-2}}\right)\\
&= Z^{-1}\left(E_f(z)\cdot\underbrace{\frac{-r\cdot z^{-1}}{1+r\cdot c\cdot z^{-1}+r^2\cdot z^{-2}}}_{pseudo\ \max\ resgradientfilter}\right)
\end{aligned}$$

The main difference between the pseudo maxres algorithm and the normal pseudo gradient algorithm discussed before is that the notch filtered signal can be used as the input to the gradient calculation filter. This can be observed in the frequency sensitivity plot as a dead zone just around the notch frequency (compare FIG. 12). The dead zone is inversely proportional to the radius coefficient $r_{dz}$. The pseudo maxres gradient filter is expressed as follows:

$$\left.\begin{aligned}
g(n) &= e_f(n)-r_{dz}\cdot c(n)\cdot g(n-1)-r_{dz}^2\cdot g(n-2)\\
\nabla^{pm}c(n) &= -r_{dz}\cdot g(n-1)
\end{aligned}\right\} \tag{15}$$

pseudo maxres gradient filter

If $r_{dz}\rightarrow 1$ then the pseudo maxres gradient $\nabla^{pm}$ c(n) becomes identical with the pseudo gradient of equation (7). However, setting $r_{dz}$ equal to 1 is not a numerically sound choice.

Similar as in the above described cases a true maxres gradient algorithm may be employed. When this algorithm is derived, a pseudo to true gradient filter is observed expressed by the following formulae:

$$\begin{aligned}
g(n) &= e_f(n)-r_{dz}\cdot c(n)\cdot g(n-1)-r_{dz}^2\cdot g(n-2) \qquad (16)\\
\nabla^{pm}c(n) &= -r_{dz}\cdot g(n-1)\\
g(n) &= (1-r)\cdot\nabla^{pm}c(n)-r\cdot c(n)\cdot g(n-1)-r^2\cdot g(n-2)\\
\nabla^{tm}c(n) &= g(n)-r\cdot g(n-2)\\
p(n) &= \alpha\cdot p(n-1)+\nabla^{tm}c(n)\\
c(n+1) &= c(n)+\frac{\mu}{p(n)}\cdot x(n)\cdot\nabla^{pm}c(n)
\end{aligned}$$

Figure 12:
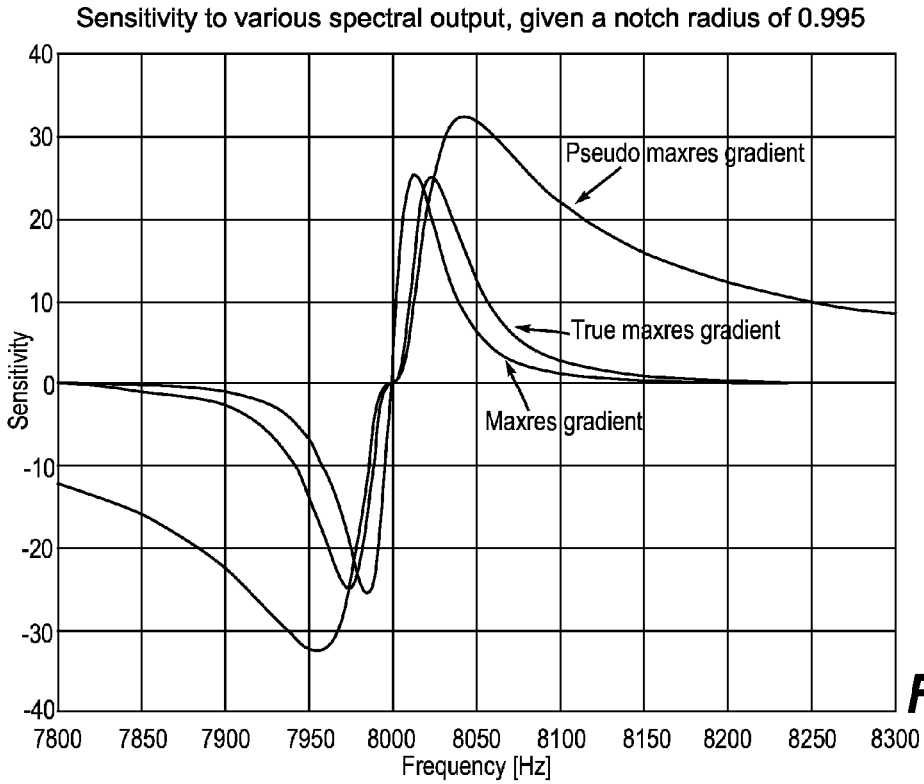
FIG. 12 is a diagram illustrating the sensitivity of three further gradient filters.

The sensitivities of the maxres gradient, the pseudo maxres gradient and the true maxres gradient are depicted in FIG. 12. The dead zone of the latter two gradient filters can be readily recognized in the plot.

As explained in detail before the adaptive narrow-band filter or in particular the adaptive notch filter, is configured such as to minimize a given cost function as for example the signal energy of the output signal. As mentioned, alternatively, a signal energy of a hypothetical resonator can be maximized.

Figure 6:
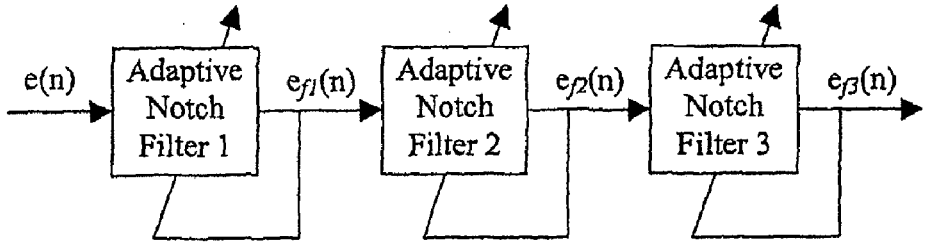
Prior Art Fig. 6
FIG. 6 is a block diagram illustrating a set of adaptive notch filters according to the prior art.

It is known to use a cascade of adaptive notch filters connected in series as shown in FIG. 6. Error signal e(n) is fed to adaptive notch filter 1 having a center frequency f1. The notch filter output signal $e_{f1}(n)$ is then fed into adaptive notch filter 2 having center frequency f2 and so forth. As much as eight or ten or more notch filters may be employed for achieving a satisfactory feedback cancellation. Every filter of the cascade of adaptive notch filters minimizes its own immediate output. This is a perfectly sufficient algorithm in the case of a static signal composition. After each notch stage one further sinusoid is removed from the signal. When the signal spectrum is fluctuating, however, this method proves to be inadequate. Now the first notch may jump from one sinusoid to another not taking into account that one of the later notch stages may already have adapted to this other sinusoid frequency. This leads to the generation of audible artefacts of the feedback cancellation system.

To avoid this problem the present invention provides according to one aspect a set of adaptive notch filters connected in series configured such that a single shared cost function is minimized. An optimization (minimization or maximization) according to this cost function makes each notch filter of the set of notch filters aware of the effectiveness of all other notch filters. The cost function derived from the output signal of the last filter of the set of adaptive notch filters is fed back to all filters for the optimization process as is shown schematically in FIG. 7.

With this method the effectiveness of the narrow-band filtering can be greatly improved, in particular for rapidly fluctuating signals.

Figure 7:
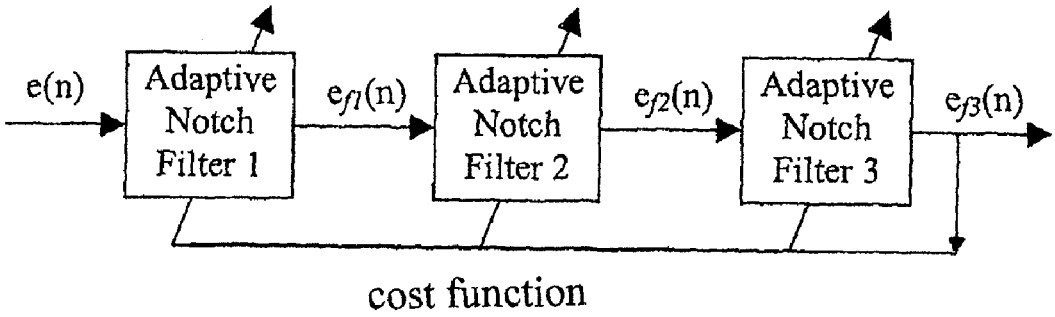
FIG. 7 illustrates a set of adaptive notch filters according to an embodiment of the present invention.

One problem appearing with the filter arrangement shown in FIG. 7 is the increase of the amount of mathematical operations required for the gradient calculation with the increase of the number of notch filters. The calculation cost is roughly proportional to the square of the number of filters thus increasing heavily if a large number of notch filters (and center frequencies) is utilized.

Figure 8:
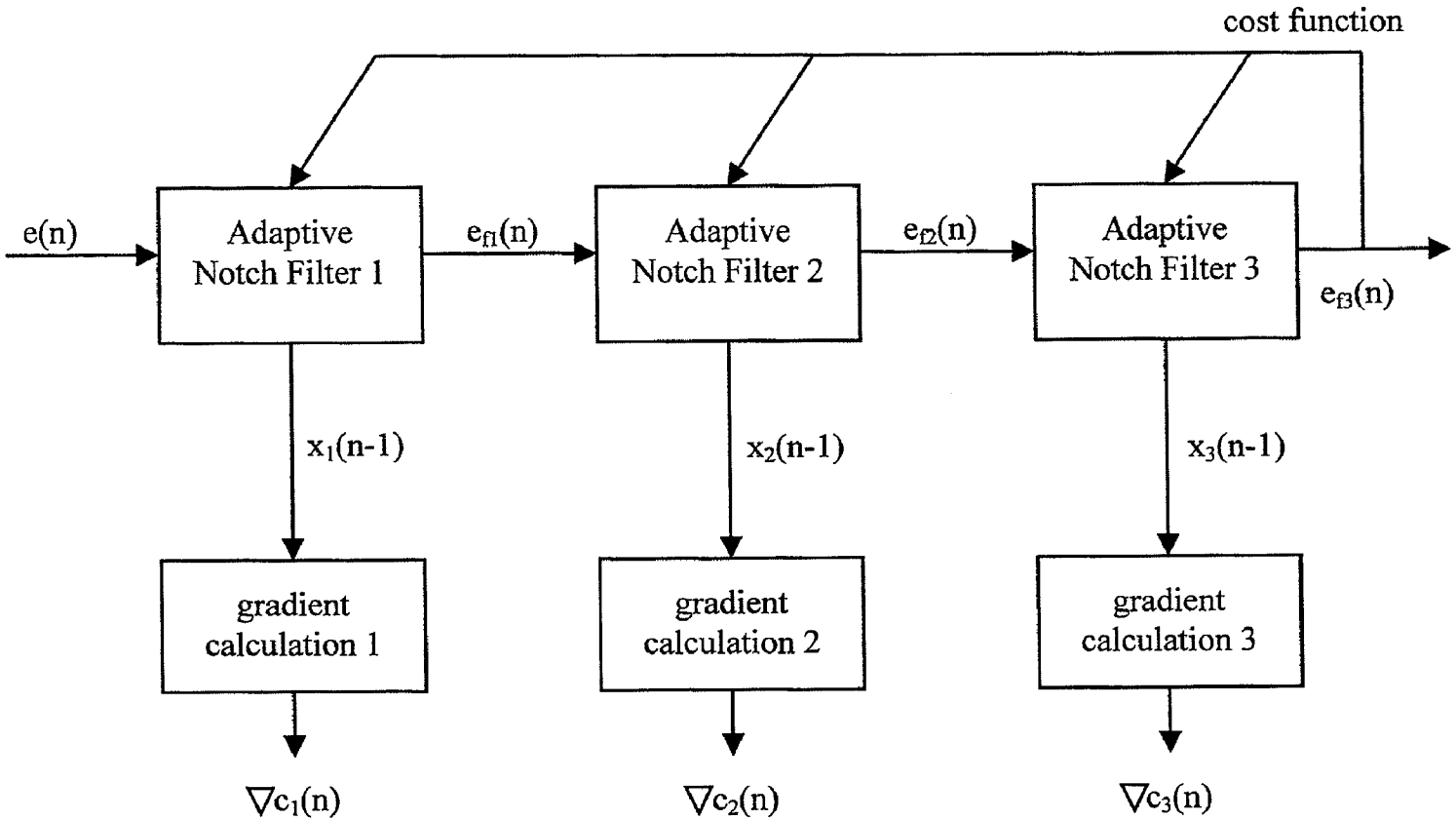
FIG. 8 illustrates a set of adaptive notch filters according to a further embodiment of the present invention.

In order to solve this problem an arrangement as shown in FIG. 8 is proposed wherein a single shared cost function derived from the output of the last stage narrow-band filter is used as in the arrangement shown in FIG. 7, but the gradient calculations are performed independently for each filter stage. This shared error methodology works well as long as the center frequencies of the respective notch filters are sufficiently spaced from each other. For this reason it is preferable to use the filter arrangement of FIG. 8 in connection with more narrow band gradient algorithms as e.g. the true gradient algorithm, maxres gradient algorithm or true maxres algorithm explained before.

Figure 9:
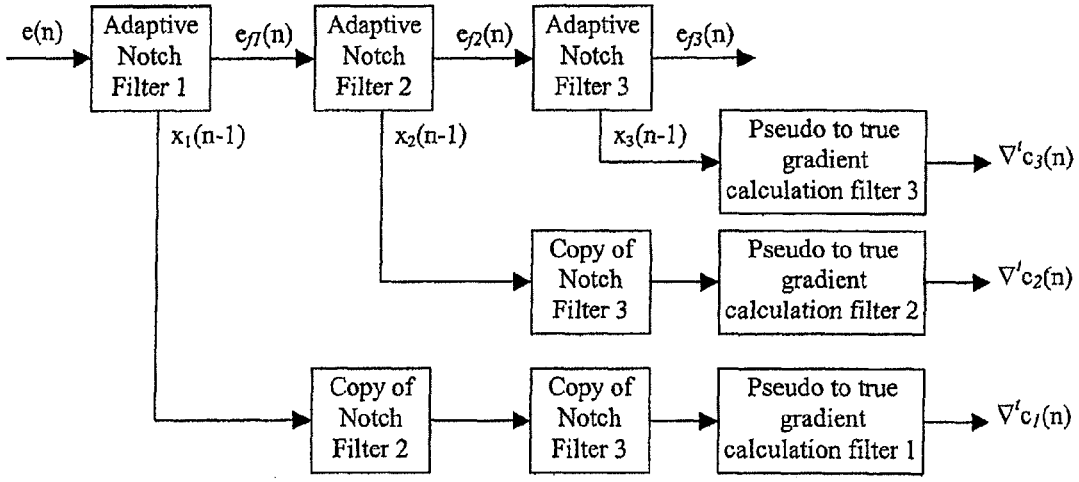
FIG. 9 is a block diagram illustrating the gradient calculation according to an embodiment of the present invention.

Another possibility to reduce the computational costs of the gradient calculation of a set of notch filters using a shared cost function is illustrated in FIG. 9. The calculations performed by the second and further notch filters, can to some extent be re-used for the gradient calculations of the other filters since the gradient calculation result is order invariant, i.e. the computation result of a cascade of linear filters is independent of the order of these filters. Furthermore, if the notch filters are implemented in a direct form II realization a part of the gradient calculation can be extracted from the notch filters themselves. In the example of FIG. 8 the number of calculations for N=3 adaptive notch filters is reduced from 1+2+3=6 gradient calculations to three gradient calculations.

Figure 10:
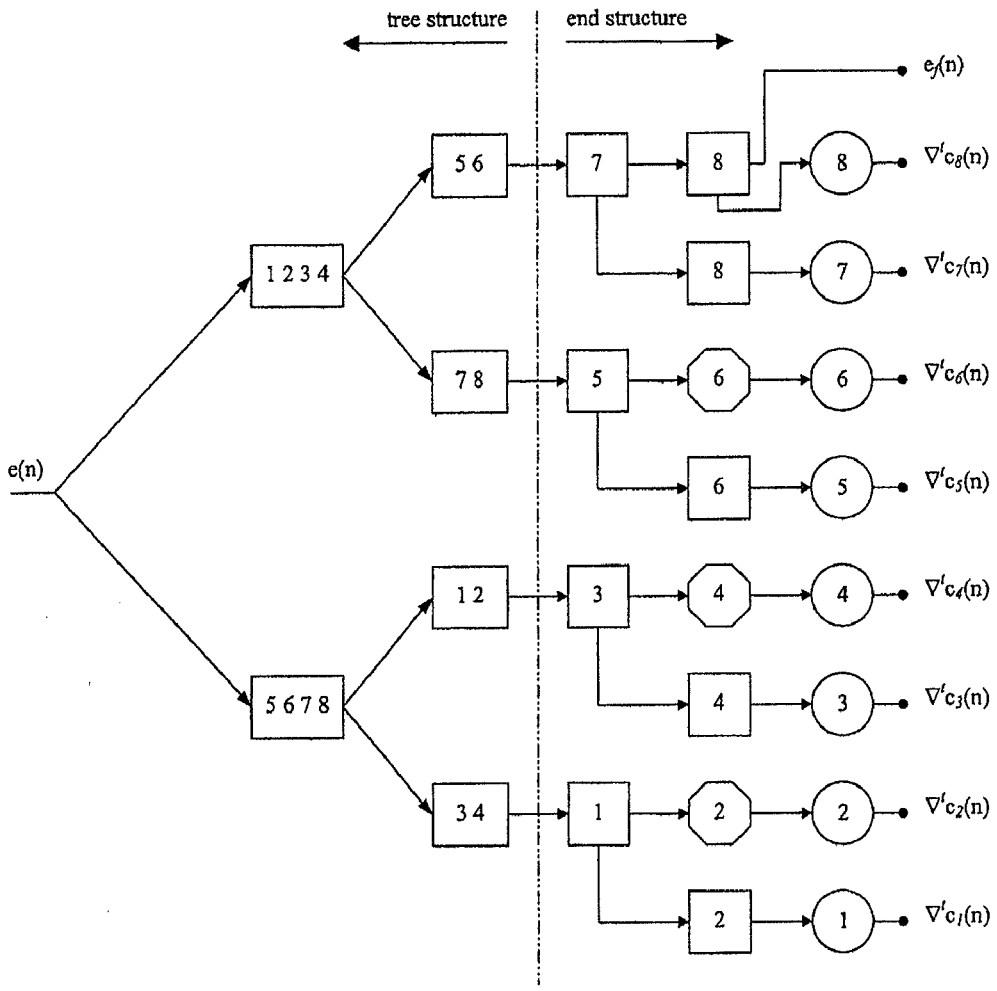
FIG. 10 is a block diagram illustrating the tree structure for gradient calculation according to a further embodiment of the present invention.

If a larger number of notch filters is required, however, a further reduction of computational costs may be necessary. For this purpose, according to one aspect of the present invention, a tree structure for the notch filter arrangement is provided as schematically shown in FIG. 10. In this figure, notch filters are illustrated as squares, pseudo to true gradient conversion filters as circles and the octogons symbolize pseudo gradient calculation filters, which—again—are equivalent to the calculation of the notch filter's internal state x(n) given in formula (3).

In the embodiment shown in FIG. 9, however, the tree structure is after two stages replaced by the end structure proving somewhat more effective than the complete tree structure. In this realization the relationship between the number of calculations and the number of effective notch filters is given by:

$$M=k_1 N \log 2(N)+k_2 N \tag{17}$$

wherein N is the number of filters and $k_1$ and $k_2$ are implementation dependent constants. For implementing a tree structure, naturally, the number of filters N should be an integer power of 2, that is $2^2, 2^3, 2^4, \ldots$ A similar result can be obtained by implementing the tree structure to the maxres gradient algorithm (see above) which requires that each and every filter stage is realized as the very last of all filters.

If the pseudo maxres or a true maxres gradient calculation algorithms are utilized, the implementation is very effective as these two gradient algorithms can be calculated from the output of the entire series of notch filters, that is the notch filtered signal can be used as the input of the gradient calculation filter. The consequence of this effective implementation is the central "dead zones" reflected in the sensitivity plots of FIG. 12. This is also true for multiple notch filters, where the pseudo maxres gradient filters belonging to each adaptive notch filter are applied to the final output of the set of notch filters. If the pseudo to true gradient filter is extended to this filter result the true maxres gradient algorithm is obtained for multiple notches. The computational cost of both these algorithms increases only linearly with the number of notch filters applied.

I claim:

1. A hearing aid comprising:

an input transducer for deriving an electrical input signal from an acoustic input, a signal processor for generating an electric output signal, an output transducer for transforming the electrical output signal into an acoustic output, an adaptive estimation filter for generating a feedback estimation signal, at least one first adaptive narrow-band filter for narrow-band-filtering an input signal of the signal processor, at least one second adaptive narrow-band filter for narrow-band-filtering a reference signal corresponding to an input signal of the adaptive estimation filter, an adaptation mechanism for updating the filter coefficients of the adaptive estimation filter based on the output signals of the first and second narrow-band filters, wherein the filters of the first and second adaptive narrow-band filters are each configured as a cascade of individual filter stages, and each configured to minimize a single shared cost function, and wherein the cost function derived from an output signal of the last filter stage is fed back to each individual filter stage of the cascade of filter stages.

2. The hearing aid according to claim 1, wherein the cascade of filter stages within the second adaptive narrow-band filter are copies of the cascade of filter stages within the first adaptive narrow-band filter.

3. The hearing aid according to claim 2, wherein the filter stages of the first adaptive narrow-band filter are at least partially arranged in a tree structure.

4. A hearing aid comprising:

an input transducer for deriving an electrical input signal from an acoustic input, a signal processor for generating an electric output signal, an output transducer for transforming the electrical output signal into an acoustic output, an adaptive estimation filter for generating a feedback estimation signal, at least one first adaptive narrow-band filter for narrow-band-filtering an input signal of the signal processor, at least one second adaptive narrow-band filter for narrow-band-filtering a reference signal corresponding to an input signal of the adaptive estimation filter, an adaptation mechanism for updating the filter coefficients of the adaptive estimation filter based on the output signals of the first and second narrow-band filters, wherein the filters of the first and second adaptive narrow-band filters are each configured as a cascade of filter stages, and each configured to minimize a single shared cost function, wherein the cascade of filter stages within the second adaptive narrow-band filter are copies of the cascade of filter stages within the first adaptive narrow-band filter, wherein the cost function derived from an output signal of the last filter stage is fed back to all filter stages of the cascade of filter stages, and wherein at least one of said first and second adaptive narrowband filters involves gradient calculations of the plurality of filter stages of the first or the second adaptive narrow-band filter performed independently of each other.

5. The hearing aid according to claim 2, wherein the first or the second adaptive narrow-band filter performs a calculation of a combined gradient, wherein a narrow-band gradient is calculated if the center frequency adaptation rate is below a predetermined threshold value, and a broader band gradient is calculated if the center frequency adaptation rate of the adaptive narrow-band filter is above the predetermined threshold value.

6. The hearing aid according to claim 1, wherein the adaptive estimation filter employs a least mean square (LMS) algorithm for feedback reduction.

7. The hearing aid according to claim 1, wherein the adaptation mechanism performs a cross correlation processing of the outputs $e_f(n)$ of the filter stages of the first adaptive narrow-band filter and the outputs $u_f(n)$ of the stages of the second adaptive narrow-band filter.

8. The hearing aid according to claim 1, wherein the filter stages within the first and the second adaptive narrow-band filters comprise notch filters having an adaptive center frequency c(n) with frequency width r.

9. A method of adaptively reducing an acoustic feedback of a hearing aid having an input transducer for deriving an electrical input signal from an acoustic input, a signal processor for generating an electrical output signal and an output transducer for transforming the electrical output signal into an acoustic output, the method comprising the steps of:

generating a feedback estimation signal, deriving an error signal by subtracting the feedback estimation signal from the electrical input signal, narrow-band-filtering the error signal and a reference signal corresponding to a feedback estimation input signal in a plurality of filter stages having different adaptive center frequencies, adapting feedback estimation filter coefficients based on the narrow-band-filtered error and reference signals, wherein the narrow-band filtering using a plurality of different adaptive center frequencies is performed using a cascade of individual filter stages, and minimizing a single shared cost function for the different adaptive center frequencies, wherein the cost function derived from an output signal of the last filter stage is fed back to each individual filter stage of the cascade of filter stages.

10. A method of adaptively reducing an acoustic feedback of a hearing aid having an input transducer for deriving an electrical input signal from an acoustic input, a signal processor for generating an electrical output signal and an output transducer for transforming the electrical output signal into an acoustic output, the method comprising the steps of:

generating a feedback estimation signal, deriving an error signal by subtracting the feedback estimation signal from the electrical input signal, narrow-band-filtering the error signal and a reference signal corresponding to a feedback estimation input signal in a plurality of filter stages having different adaptive center frequencies, wherein the narrow-band filtered reference signal is derived from a gradient of the narrow-band filtered error signal, and adapting feedback estimation filter coefficients based on the narrow-band-filtered error and reference signals, wherein the narrow-band filtering using a plurality of different adaptive center frequencies is performed using a cascade of filter stages, and minimizing a single shared cost function for the different adaptive center frequencies, wherein the cost function derived from an output signal of the last filter stage is fed back to all filter stages of the cascade of filter stages.

11. The method according to claim 10, wherein the gradient calculation is performed employing a least a partial tree structure of filter stages.

12. The method according to claim 10, wherein the gradient calculations of different adaptive narrow-band filter stages are performed independently of each other.

13. The method according to claim 9, wherein a combined gradient calculation is performed, wherein a narrow-band gradient is calculated if the center frequency adaptation rate is below a predetermined threshold value and a broader band gradient is calculated if the center frequency adaptation rate of the adaptive narrow-band filter is above the predetermined threshold value.

14. The method according to claim 9, wherein the feedback estimation signal is generated using a least mean square (LMS) algorithm.

15. The method according to claim 9, wherein the feedback estimation filter coefficients are adapted utilizing a cross correlation processing of the narrow-band filtered error signal with the narrow-band filtered reference signal.

16. The method according to claim 9, wherein the narrow-band filtering is performed by notch filters having an adaptive center frequency c(n) with frequency width r.

17. A computer program product comprising nontransitory computer-readable medium storing program code for performing, when run on a computer, a method of adaptively reducing an acoustic feedback of a hearing aid having an input transducer for deriving an electrical input signal from an acoustic input, a signal processor for generating an electrical output signal and an output transducer for transforming the electrical output signal into an acoustic output, the method comprising the steps of:

generating a feedback estimation signal, deriving an error signal by subtracting the feedback estimation signal from the electrical input signal, narrow-band-filtering the error signal and a reference signal corresponding to a feedback estimation input signal in a plurality of filter stages having different adaptive center frequencies, adapting feedback estimation filter coefficients based on the narrow-band-filtered error and reference signals, wherein the narrow-band filtering using a plurality of different adaptive center frequencies is performed using a cascade of individual filter stages, and minimizing a single shared cost function for the different adaptive center frequencies, wherein the cost function derived from an output signal of the last filter stage is fed back to each individual filter stage of the cascade of filter stages.

18. An electronic circuit for a hearing aid comprising:

a signal processor for processing an electrical input signal derived from an acoustic input and generating an electrical output signal, an adaptive estimation filter for generating a feedback estimation signal, at least one first adaptive narrow-band filter for narrow-band-filterine, an input sianal of the signal processor, at least one second adaptive narrow-band filter for narrow-band-filtering a reference signal corresponding to an input signal of the adaptive estimation filter, an adaptation mechanism for updating the filter coefficients of the adaptive estimation filter based on the output signals of the first and second narrow-band filters, wherein the first and second adaptive narrow-band filters are each configured as a cascade of individual filter stages, and each configured to minimize a single shared cost function, wherein the cost function derived from an output signal of the last filter stage is fed back to each individual filter stage of the cascade of filter stages.

* * * * *